US008512070B2

(12) United States Patent
De France

(10) Patent No.: US 8,512,070 B2
(45) Date of Patent: Aug. 20, 2013

(54) SPRING LOADED CLAMP

(75) Inventor: Robert V. De France, Poughkeepsie, NY (US)

(73) Assignee: Hubbell Incorporated, Shelton, CT (US)

( * ) Notice: Subject to any disclaimer, the term of this patent is extended or adjusted under 35 U.S.C. 154(b) by 247 days.

(21) Appl. No.: 12/928,129

(22) Filed: Dec. 3, 2010

(65) Prior Publication Data

US 2012/0142231 A1 Jun. 7, 2012

(51) Int. Cl.
*H01R 13/00* (2006.01)

(52) U.S. Cl.
USPC ..... 439/479; 439/803

(58) Field of Classification Search
USPC ..... 439/477–479, 803, 815
See application file for complete search history.

(56) References Cited

U.S. PATENT DOCUMENTS

| | | | | | |
|---|---|---|---|---|---|
| 2,397,390 | A | | 3/1946 | Wadsworth | 173/273 |
| 2,574,796 | A | | 11/1951 | Moore | 173/273 |
| 2,651,766 | A | | 9/1953 | Runde | 339/246 |
| 2,811,703 | A | | 10/1957 | Becker | 339/264 |
| 2,958,067 | A | * | 10/1960 | Hardy | 439/479 |
| 3,142,525 | A | | 4/1962 | Roosman | 339/109 |
| 3,036,286 | A | | 5/1962 | Gorc et al. | 339/109 |
| 3,075,166 | A | | 1/1963 | Peek | 339/109 |
| 3,614,700 | A | * | 10/1971 | Beard et al. | 337/203 |
| 3,923,363 | A | * | 12/1975 | Kraft | 439/413 |
| 4,183,686 | A | * | 1/1980 | De France | 403/11 |
| 4,707,051 | A | * | 11/1987 | Hall | 439/781 |
| 5,547,404 | A | | 8/1996 | Nellis, Jr. et al. | 439/803 |
| 5,692,930 | A | * | 12/1997 | Garver et al. | 439/781 |
| 7,029,316 | B2 | * | 4/2006 | Jackson, III | 439/477 |

OTHER PUBLICATIONS

"Lightning Arrester Accessories", Fargo Mfg. Company, Inc. Fargo Catalog, 1995, Section 5, p. 13.
"Tamuel Orbital Headforming", Taumel Assembly Systems, Taumel Catalog, 1996, p. 1.

* cited by examiner

*Primary Examiner* — Xuong Chung Trans
(74) *Attorney, Agent, or Firm* — Harrington & Smith

(57) ABSTRACT

Disclosed herein is an electrical connector. The electrical connector includes an upper member, a lower member, a fastening member, and a spring. The upper member includes a first end, a second end, and an upper groove portion. The upper groove portion is between the first and second ends. The first end includes a first opening. The lower member includes a lower groove portion, a receiving area, and a hole. A portion of the upper member extends into the receiving area. An end of the hole is at the receiving area. The fastening member extends through the hole and the opening. The first end of the fastening member includes an operable portion. The spring is between the second end of the fastening member and the upper member. A portion of the spring is in the opening. The first end of the upper member is between opposite ends of the spring.

25 Claims, 4 Drawing Sheets

SPRING LOADED CLAMP

CROSS REFERENCE TO RELATED APPLICATION

This application claims priority under 35 U.S.C. §119(e) to U.S. provisional patent application No. 61/283,302 filed Dec. 2, 2009 which is hereby incorporated by reference in its entirety.

BACKGROUND

1. Field of the Invention

The invention relates to an electrical connector and, more particularly, to a spring loaded clamp.

2. Brief Description of Prior Developments

Power line clamp connectors for making a connection to an overhead power distribution lines are known in the art. U.S. Pat. Nos. 3,036,286 and 3,075,166 disclose conventional hot line clamps having an eyebolt for mechanically and electrically connecting electrical lines together. Additionally, arrester line connectors, which allow for the installation of a lightning arrester directly on a line, are known in the art. For example, one such arrester line connector clamp is catalog number GH-201D, provided by Fargo Mfg. Company, Inc. (a subsidiary of Hubbell Incorporated). One drawback to conventional configurations is that precise and labor intensive movement of a utility lineman's hot stick is required to manipulate the eyebolt during clamp installation. As maintenance and installation operations become increasingly difficult, the added time required for these operations can increase operating costs for the utility company.

Accordingly, there is a need for an improved power line clamp connector which alleviates installation difficulties.

SUMMARY

The foregoing and other problems are overcome, and other advantages are realized, by the use of the exemplary embodiments of this invention.

In accordance with one aspect of the invention, an electrical connector is disclosed. The electrical connector includes an upper member, a lower member, a fastening member, and a spring. The upper member includes a first end, a second end, and an upper groove portion. The second end is opposite the first end. The upper groove portion is between the first end and the second end. The first end includes a first opening. The lower member includes a lower groove portion, a receiving area, and a hole. The lower groove portion is opposite the upper groove portion. A portion of the upper member extends into the receiving area. An end of the hole is at the receiving area. The fastening member extends through the hole and the first opening. The fastening member includes a first end and an opposite second end. The first end of the fastening member includes an operable portion. The spring is between the second end of the fastening member and the upper member. A portion of the spring is in the first opening. The first end of the upper member is between opposite ends of the spring.

In accordance with another aspect of the invention, an electrical connector is disclosed. The electrical connector includes an upper member, a lower member, a fastener, and a spring. The upper member includes an opening. The lower member includes a cavity, a hole, and an aperture. A portion of the upper member is received at the cavity. An end of the hole is at the cavity. The aperture is adapted to receive a first conductor. The electrical connector is adapted to receive a second conductor between the upper member and the lower member. The fastener extends through the hole and the opening. The lower member is engaged with a first portion of the fastener. The upper member is movably connected to a second portion of the fastener. The spring is at the second portion of the fastener. The spring exerts a biasing force between an end of the fastener and the upper member.

In accordance with another aspect of the invention, an electrical connector is disclosed. The electrical connector includes an upper member, a lower member, a fastening member, and a resilient member. The upper member includes a first end, a second end, an upper groove portion, and boss portion. The second end is opposite the first end. The upper groove portion is between the first end and the second end. The first end includes a first opening. The second end includes a second opening. The boss portion is at the second end. The lower member includes a lower groove portion, a receiving area, an aperture, and a hole. The receiving area is between the lower groove portion and the aperture. An end of the hole is at the receiving area. At least part of the boss portion is at the receiving area. The fastening member extends through the hole and the second opening. The fastening member includes a first end and an opposite second end. The first end of the fastening member includes an operable portion. The second end of the fastening member extends beyond the first end of the upper member. The resilient member is between the second opening and the second end of the fastening member.

In accordance with another aspect of the invention, a method of manufacturing an electrical connector is disclosed. An upper member having a first end, a second end, and an upper groove portion is provided. The second end is opposite the first end. The upper groove portion is between the first end and the second end. A lower member having a lower groove portion, a receiving area, and a hole is provided. The lower groove portion is opposite the upper groove portion. The second end of the upper member extends into the receiving area. An end of the hole is at the receiving area. A fastening member is engaged at the hole. The fastening member includes a first end and an opposite second end. The first end of the fastening member includes an operable portion. A spring is provided between the upper member and a second end of the fastening member. A spring retaining portion is provided at the second end of the fastening member. The spring retaining portion is at the first end of the upper member.

BRIEF DESCRIPTION OF THE DRAWINGS

The foregoing aspects and other features of the invention are explained in the following description, taken in connection with the accompanying drawings, wherein.

DETAILED DESCRIPTION

Figure 1:
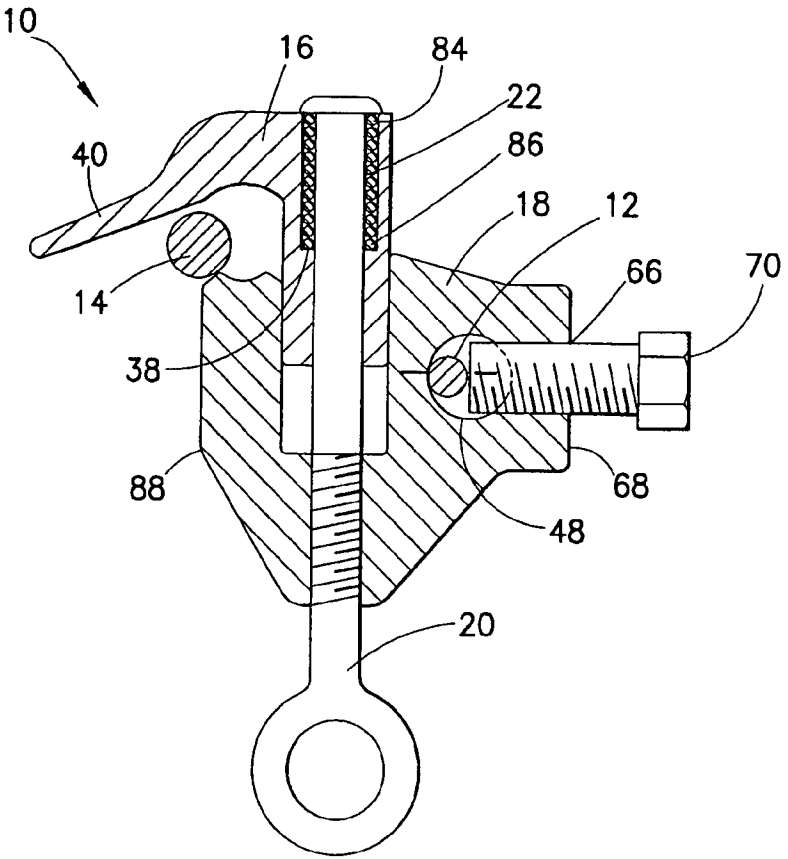
FIG. 1 is a section view of an electrical connector incorporating features of the invention.

Referring to FIG. 1, there is shown a section view of an electrical connector 10 incorporating features of the invention. Although the invention will be described with reference to the exemplary embodiment shown in the drawings, it should be understood that the invention can be embodied in many alternate forms of embodiments. In addition, any suitable size, shape or type of elements or materials could be used.

As shown in FIG. 1, the electrical connector, or spring loaded clamp, 10 is configured to electrically connect a first electrical conductor 12 to a second electrical conductor 14. FIG. 1 depicts the first conductor 12 in an installed position and the second conductor 14 in a pre-installation position. The first conductor 12 may be a tap wire, or tap line, conductor for example. The second conductor 14 may be a main conductor such as a run cable, or feeder cable, conductor for example. However, it should be understood that alternate embodiments may accommodate any combination of conductor types and/or sizes. The spring loaded clamp 10 provides an improved clamp connector which may be installed using a utility lineman's hot stick (not shown).

The spring loaded clamp 10, which may be a spring loaded hot line clamp for example, includes an upper member 16, a lower member 18, a threaded fastener 20, and a spring 22.

Figure 2:
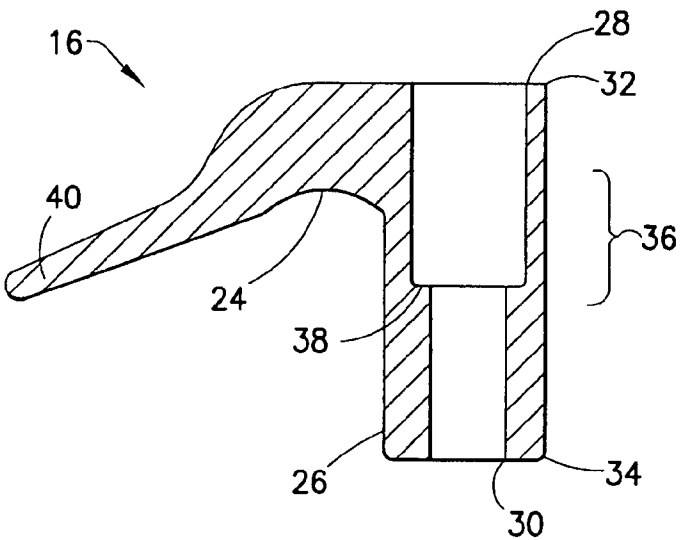
FIG. 2 is a section view of an upper member of the electrical connector shown in FIG. 1.

Referring now also to FIG. 2, the upper member, or upper pad, 16 comprises a groove portion 24, a boss portion 26, a first opening 28 and a second opening 30. The upper member 16 may be a one-piece member fabricated from an electrically conductive material, such as metal for example.

The groove portion, or upper groove portion, 24 provides a surface configured to contact an upper portion of the conductor under a clamping force between the upper member 16 and the lower member 18. The groove portion 24 is between a first end (or top end) 32 of the upper member 16 and a second end (or bottom end) 34 of the upper member 16. In the embodiment shown in FIG. 2, the groove portion 24 may be proximate the top end 32, however in alternate embodiments, the groove portion 24 may be provided at any suitable location. It should further be understood that the groove portion may comprise any suitable shape for contacting the conductor.

The first opening 28 extends between the first end 32 and a middle portion 36 of the upper member 16. The opening 28 extends through the upper member 16 in a direction substantially perpendicular to the groove portion 24. The first opening, or cavity, 38 comprises a first diameter and is suitably sized and shaped to receive the spring 22.

The boss portion 26 extends from the middle portion 36 of the upper member 16 proximate the groove portion 24. An end of the boss portion forms the second end 34 of the upper member 16. The boss portion 26 is suitably sized and shaped to be received by, and movably connected to, the lower member 18. The second opening 30 extends between the second end (or the end of the boss) and the middle portion 36. The second opening 30 comprises a second diameter and is suitably sized and shaped to receive a portion of the fastening member 20.

The first opening 28 and the second opening 30 intersect each other at the middle portion 36 such that the first opening 28 is substantially concentric to the second opening 30. This orientation of the first and second openings forms a step, or general counterbore configuration, 38 at the intersection of the first opening 28 and the second opening 30, as the first diameter is greater than the second diameter. The step is suitably sized and shaped to serve as a spring contact surface, or spring seat when the spring 22 is installed in the opening 28.

The upper member 16 may further comprise a lead-in feature 40 extending from the top end 32 and the groove portion 24. The lead-in feature 40 may comprise a general duck bill shape, and extends away from the groove portion 24 at a suitable angle to facilitate engagement of the conductor.

Figure 3:
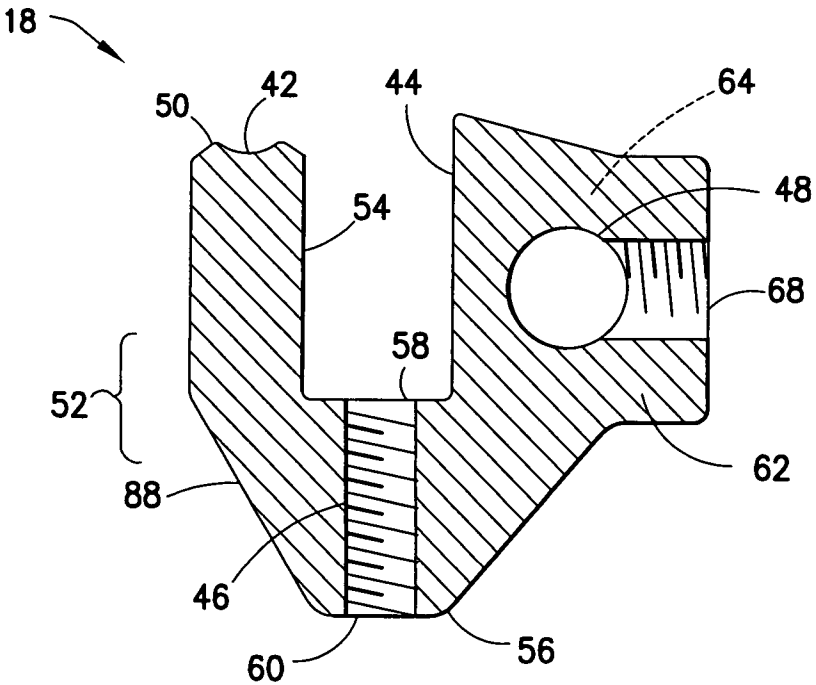
FIG. 3 is a section view of a lower member of the electrical connector shown in FIG. 1.

Referring now also to FIG. 3, the lower member, or lower pad, 18 comprises a groove portion 42, a receiving area 44, a threaded hole 46, and an aperture 48. The lower member 18 may be a one-piece member fabricated from an electrically conductive material, such as metal for example.

The groove portion, or lower groove portion, 42 is opposite the upper groove portion 24 and provides a surface configured to contact a lower surface of the conductor under the clamping force between the upper member 16 and the lower member 18. The groove portion 42 is at a first end (or top end) 50 of the lower member 18. However, it should be noted that in alternate embodiments, the groove portion may be provided at any suitable location. It should further be understood that the groove portion may comprise any suitable shape for contacting the conductor.

The receiving area 44 is between the lower groove portion 42 and the aperture 48. The receiving area 44 also extends between the first end 50 and a middle portion 52 of the lower member 18. The receiving area, or cavity, 44 comprises a complementary shape suitably sized to receive the boss portion 26 of the upper member 16. Additionally, side walls 54 of the receiving area 44 may contact the boss portion 26 when the upper member 16 slides up or down (along the receiving area 44) during conductor installation/removal and/or adjustment of the fastener 20.

The threaded hole 46 extends between the receiving area 44 and a second end (or bottom end) 56 of the lower member 18, wherein one open end 58 of threaded hole is at the receiving area 44 and the other open end 60 of the threaded hole 46 is at the second end 56. The threaded hole 46 is oriented to be substantially aligned with the first opening 28 and the second opening 30 of the upper member 16. This orientation provides for the threaded hole 46 to be substantially perpendicular to the conductor groove portion 42 and to the aperture 48. In this embodiment, the threaded hole 46 comprises left hand threads. However, in alternate embodiments, the threaded hole may comprise right hand threads.

The aperture 48 may be provided proximate the middle portion 52 of the lower member 18 adjacent the receiving area 44. However, in alternate embodiments any suitable location for the aperture may be provided. The aperture 48 extends from a front side 62 to a rear side 64 of the lower member 18. The aperture 48 may comprise any suitable diameter for receiving the first (or tap wire/line) conductor 12. However, it should be understood that the aperture may comprise any suitable shape/size for receiving the second conductor.

The lower member 18 further comprises an opening 66 extending from the aperture 48 to a lateral side 68 of the lower member 18 (see FIG. 1). The opening extends substantially perpendicular to the aperture 48. The opening 66 may be a threaded opening and be adapted to receive a bolt 70 (see FIG. 1) for securing the first conductor 12 in the aperture 48. For example, the tap conductor 12 may be attached by inserting the tap conductor 12 into the aperture 48 and then tightening the bolt 70. However, it is to be understood that any other suitable type of fastener or fastening method for securing the conductor to the aperture may be provided.

Figure 4:
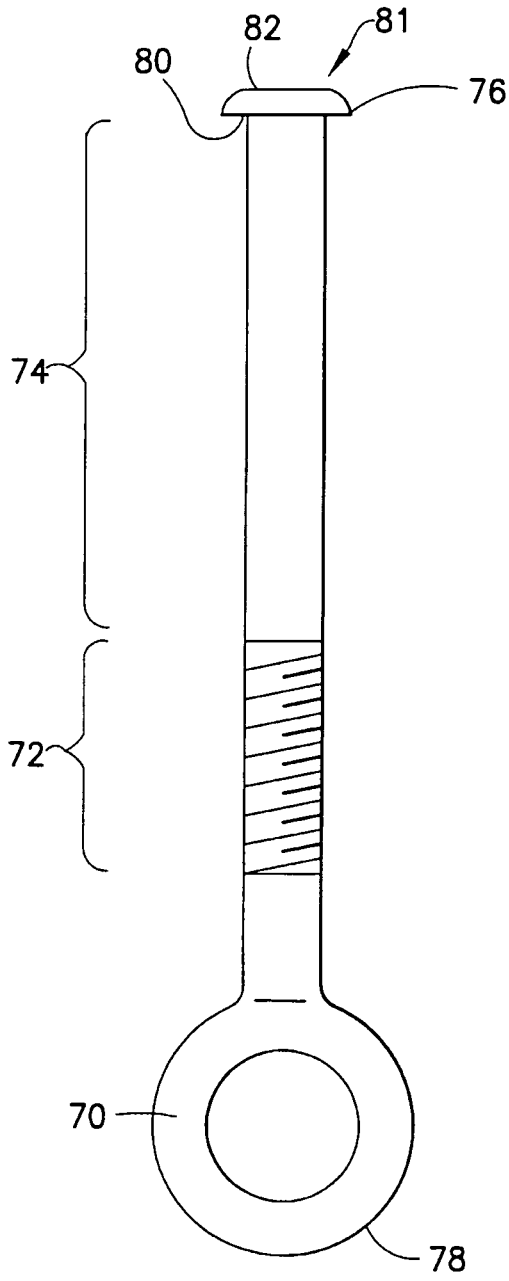
FIG. 4 is a side view of a fastening member of the electrical connector shown in FIG. 1.

Referring now also to FIG. 4, the threaded fastener 20, which may be an eyebolt for example, comprises a first end 70, a first portion 72, a second portion 74, and a second end 76. The first end 70 comprises a looped end, or eyelet, 78. However, it should be understood that the first end 70 may be any suitable operable end (or operable portion) which may be operated by a utility lineman's hot stick. The first portion 72 is proximate the looped end 78 and comprises a threaded portion. The threaded portion 72 is suitably sized and shaped to be received by the threaded hole 46. In this embodiment, the threaded portion 72 comprises left hand threads. However, in alternate embodiments, the threaded portion may comprise right hand threads.

The second portion 74 extends between the threaded portion 72 and the second end 76. The second portion 74 comprises a non-threaded, or bolt shank portion. The bolt shank portion 74 is suitably sized and shaped to be received by the first opening 28 and the second opening 30 of the upper member 16. The bolt shank portion 74 provides a contact surface which allows the upper member 16 to slide along the second portion 74.

The second end 76 comprises a pan head portion 81. The pan head portion 81 comprises a raised surface forming a spring seat, or spring retaining portion, 80 adapted to contact the spring 22. The raised surface may further be suitably sized and shaped to contact the first end 32 of the upper member 16. The pan head portion may comprise a rounded head 82 and a flat surface at the spring retaining portion 80. However, any suitable shape which provides a spring seat, or spring retaining portion, for the spring 22 may be provided. Additionally, it should be noted that the pan head portion is not required, and any other suitable feature or fastener may be provided. The pad portion may be provided, or formed, by an orbital headforming process using, for example, Taumel Headforming Machines, by Taumel Assembly Systems of Patterson, N.Y. However, any suitable process or equipment may be utilized for forming the pad head portion.

The spring, or resilient member, 22 is configured to exert a biasing force between the second end 76 of the eyebolt 20 and the upper member 16. The spring 22 may be a compression coil spring, for example. However, any suitable type spring may be provided. The spring 22 is suitably sized and shaped to be received by the first opening 28. A length of the spring 22 may be provided such that a first end 84 of the spring 22 contacts the spring seat 80 at the second end 76 of the fastener 20, and such that a second end 86 of the spring 22 contacts the spring seat 38 of the upper member 16.

The clamp 10 may be assembled by providing the upper member 16, the lower member 18, and the spring 22, as described above, and further including the eyebolt 20 without the pan head portion (for example, the eyebolt may be in a pre-assembly condition wherein the eyebolt has not yet been exposed to the orbital headforming process). This allows for the eyebolt 20 to be threadably engaged with the threaded hole 46 and extended through the second opening 30, the spring 22, and the first opening 28. The pan head portion 81 may then be formed on the second end 76 of the eyebolt 20 (as described above) after the lower member 18, the upper member 16, and the spring 22 are positioned on the eyebolt 20. This configuration allows for the threaded portion 72 to secure the lower member 18 to the eyebolt 20, and the pan head portion 81 to secure the upper member 16 and the spring 22 along the bolt shank portion 74 of the eyebolt 20.

Figure 5:
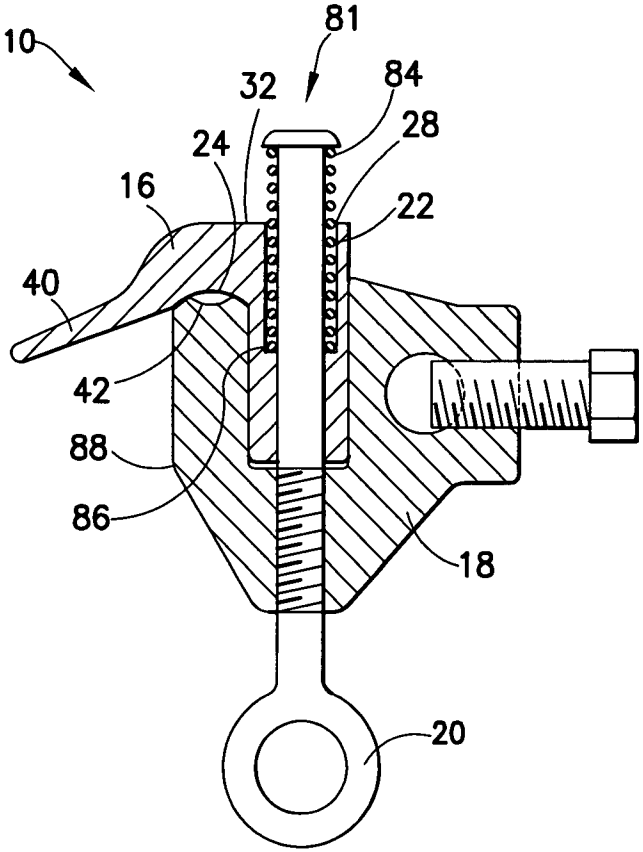
FIG. 5 is a section view of the electrical connector shown in FIG. 1 in a pre-installation position.

Referring now also to FIG. 5, the clamp 10 is shown in a pre-installation position, wherein the conductors 12, 14 are yet to be installed. In this position, the spring 22 biases the upper pad 16 towards the lower pad 18 such that the upper groove 24 is in contact with the lower groove 42. This provides for a portion of the spring 22 to be in the first opening 28, and wherein the first end 32 of the upper member 16 is between opposite ends 84, 86 of the spring 22. In this position, the second end 76 of the fastening member 20 extends beyond the first end 32 of the upper member 16. Additionally, in this position, the spring 22 is in a substantially expanded mode.

When the clamp 10 is being installed onto the run conductor 14 (as shown in FIG. 1), the run conductor 14 may be guided into the top pad 16 by the protruding duck bill portion 40 and a lateral surface 88 of the bottom pad 18. After the conductor 14 makes contact with the duck bill 40, a downward force is applied to the eyebolt 20 while being fixed in the end of the hot stick. This forces the upper member 16 to movably slide along a length of the fastener 20. As the top pad 16 slides, the spring 22 is substantially compressed and the top pad 16 then opens up and allows the run conductor 14 to enter the clamp 10 between the conductor grooves 24, 42. Once the conductor 14 is between the grooves 24, 42, the top pad 16 is then forced downward against the run conductor 14 and clamps it between the grooves 24, 42. The force is applied by the spring 22 between the pan head 81 and the bottom of the opening 28 in the top pad 16. This further results in the top pad 16 traveling downward into the bottom pad 18 wherein the protruding boss 26 of the top pad 16 mates with the receiving area 44 of the bottom pad 18 and allows the two parts 16, 18 to self align in on direction.

According to various embodiments of the invention, the clamp 10 is provided such that the left hand threads at the fastener 20 and the threaded hole 46 allow for conventional installation and removal procedures. For example, with the left hand threads, as the eyebolt 20 is turned in a clockwise direction, it protrudes outward from the bottom pad 18. This allows the pan head 81 to butt against the top 32 of the top pad 16 thus pulling the top pad 16 downward. This allows the clamp 10 to "loosen" as the eyebolt 20 is turned in a counterclockwise direction (and "tighten" as the eyebolt 20 is turned in a clockwise direction). If the clamp 10 is provided with right hand threads at the fastener 20 and the threaded hole 46, then this allows the clamp 10 to "loosen" as the eyebolt 20 is turned in a clockwise direction (and "tighten" as the eyebolt 20 is turned in a counterclockwise direction).

According to another example of the invention, a method of manufacturing an electrical connector is disclosed. The method includes the following steps. Providing an upper member comprising a first end, a second end, and an upper groove portion, wherein the second end is opposite the first end, and wherein the upper groove portion is between the first end and the second end. Providing a lower member comprising a lower groove portion, a receiving area, and a hole, wherein the lower groove portion is opposite the upper groove portion, wherein the second end of the upper member extends into the receiving area, and wherein an end of the hole is at the receiving area. Engaging a fastening member at the hole, wherein the fastening member comprises a first end and an opposite second end, and wherein the first end of the fastening member comprises an operable portion. Providing a spring between the upper member and a second end of the fastening member. Providing a spring retaining portion at the second end of the fastening member, wherein the spring retaining portion is at the first end of the upper member. It should be noted that any of the above steps may be performed alone or in combination with one or more of the steps.

The technical effects of the various embodiments of the invention provide improvement over conventional configurations. For example, in conventional configurations, utility linemen are required to pull down and tighten the clamp (with a hot stick, for example) when installing the clamp onto a run conductor. If the tightening and pull down operations are not performed in an adequate manner, undesirable arcing may result. With the configuration of the clamp 10, installation onto the run conductor allows the utility lineman to tighten the clamp 10 without pulling down the clamp at the same time, as the connector clamps down on the conductor once the conductor is received between the conductor grooves 24, 42. The spring biased clamp provides improved contact with the conductor during installation to minimize arcing.

Figure 7:
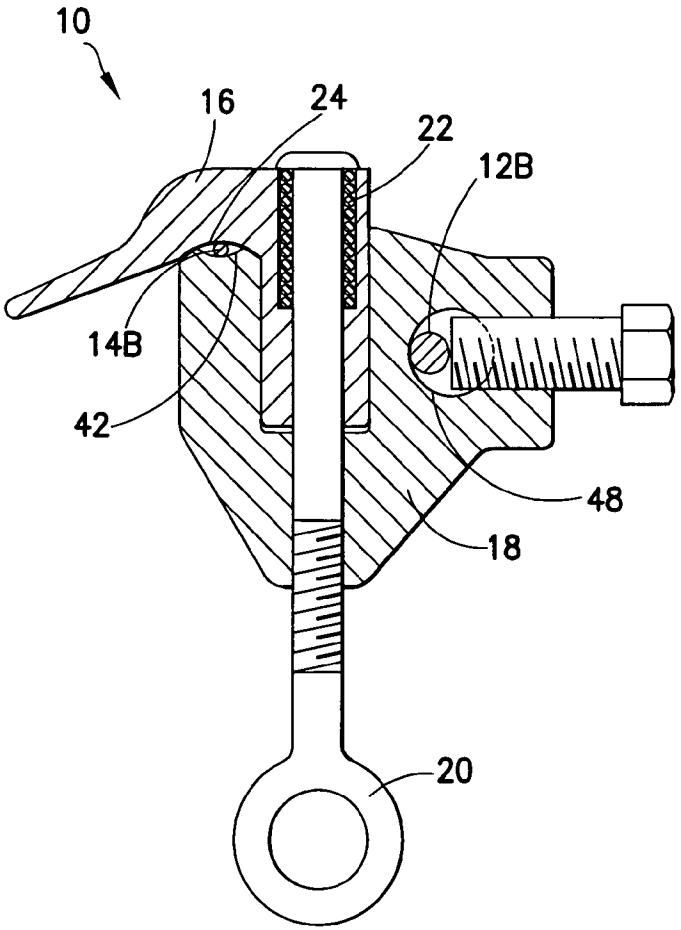
FIG. 7 is a section view of the electrical connector shown in FIG. 1 in an installation position with a substantial minimum sized run conductor installed.
Figure 6:
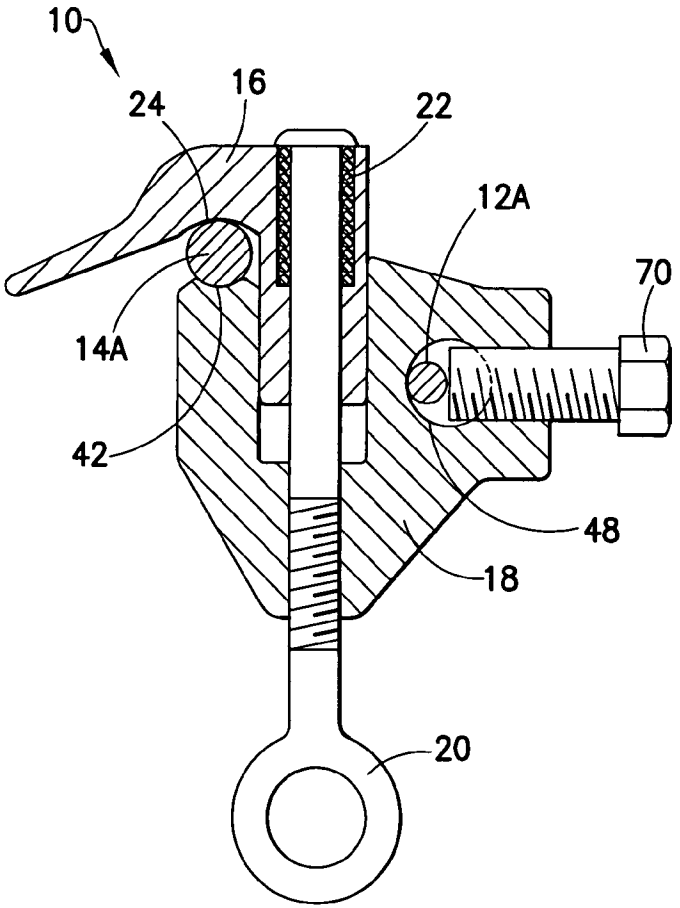
FIG. 6 is a section view of the electrical connector shown in FIG. 1 in an installation position with a substantial maximum sized run conductor installed.

It should be noted that various size conductors may be accommodated by the clamp 10. For example, FIG. 6 illustrates the clamp 10 with a substantially maximum sized run conductor 14A between the grooves 24, 42 and a larger sized tap conductor 12A at the aperture 48. For example, FIG. 7 illustrates the clamp 10 with a substantially minimum sized run conductor 14B between the grooves 24, 42 and another larger sized tap conductor 12B at the aperture 48. However, it should be understood that while various embodiments of the invention have been describe in connection with the conductors 12, 12A, 12B, 14, 14A, 14B, one skilled in the art will appreciate that the various embodiments of the invention may accommodate any suitably sized and shaped conductors.

Below are provided further descriptions of various non-limiting, exemplary embodiments. The below-described exemplary embodiments are separately numbered for clarity and identification. This numbering should not be construed as wholly separating the below descriptions since various aspects of one or more exemplary embodiments may be practiced in conjunction with one or more other aspects or exemplary embodiments. That is, the exemplary embodiments of the invention, such as those described immediately below, may be implemented, practiced or utilized in any combination (e.g., any combination that is suitable, practicable and/or feasible) and are not limited only to those combinations described herein and/or included in the appended claims.

(1) In one exemplary embodiment, an electrical connector comprising: an upper member comprising a first end, a second end, and an upper groove portion, wherein the second end is opposite the first end, wherein the upper groove portion is between the first end and the second end, and wherein the first end comprises a first opening; a lower member comprising a lower groove portion, a receiving area, and a hole, wherein the lower groove portion is opposite the upper groove portion, wherein a portion of the upper member extends into the receiving area, and wherein an end of the hole is at the receiving area; a fastening member extending through the hole and the first opening, wherein the fastening member comprises a first end and an opposite second end, and wherein the first end of the fastening member comprises an operable portion; and a spring between the second end of the fastening member and the upper member, wherein a portion of the spring is in the first opening, and wherein the first end of the upper member is between opposite ends of the spring.

An electrical connector as above, wherein the hole of the lower member further comprises a threaded hole.

An electrical connector as above, wherein the operable portion of the fastening member further comprises an eyelet.

An electrical connector as above, wherein the lower member further comprises an aperture, and wherein the lower member is adapted to receive a first conductor at the aperture.

An electrical connector as above, wherein the hole of the lower member further comprises a threaded hole, and wherein the operable portion of the fastening member further comprises an eyelet.

An electrical connector as above, wherein the lower member further comprises an aperture, and wherein the lower member is adapted to receive a first conductor at the aperture.

An electrical connector as above, wherein the electrical connector is adapted to receive a second conductor between the upper member and the lower member.

An electrical connector as above, wherein the second end of the fastener comprises a pan head, and wherein the pan head is adapted to contact an end of the spring.

An electrical connector as above, wherein the fastening member comprises a threaded portion proximate the operable portion and a non-threaded portion proximate the second end.

(2) In another exemplary embodiment, an electrical connector comprising: an upper member comprising an opening; a lower member comprising a cavity, a hole, and an aperture, wherein a portion of the upper member is received at the cavity, wherein an end of the hole is at the cavity, wherein the aperture is adapted to receive a first conductor, and wherein the electrical connector is adapted to receive a second conductor between the upper member and the lower member; a fastener extending through the hole and the opening, wherein the lower member is engaged with a first portion of the fastener, and wherein the upper member is movably connected to a second portion of the fastener; and a spring at the second portion of the fastener, wherein the spring exerts a biasing force between an end of the fastener and the upper member.

An electrical connector as above, wherein the first portion of the fastener comprises a threaded portion.

An electrical connector as above, wherein the second portion of the fastener comprises a non-threaded portion.

An electrical connector as above, the fastener comprises a pan head, wherein the pad head is spaced from the upper member when the connector is in a first position, and wherein the pan head is in contact with the upper member when the connector is in a second position.

An electrical connector as above, wherein the hole of the lower member comprises a threaded hole having left hand threads.

An electrical connector as above, wherein the fastener comprises an eyebolt.

(3) In another exemplary embodiment, an electrical connector comprising: an upper member comprising a first end, a second end, an upper groove portion, and boss portion, wherein the second end is opposite the first end, wherein the upper groove portion is between the first end and the second end, wherein the first end comprises a first opening, wherein the second end comprises a second opening, and wherein the boss portion is at the second end; a lower member comprising a lower groove portion, a receiving area, an aperture, and a hole, wherein the receiving area is between the lower groove portion and the aperture, wherein an end of the hole is at the receiving area, and wherein at least part of the boss portion is at the receiving area; a fastening member extending through the hole and the second opening, wherein the fastening member comprises a first end and an opposite second end, wherein the first end of the fastening member comprises an operable portion, and wherein the second end of the fastening member extends beyond the first end of the upper member; and a resilient member between the second opening and the second end of the fastening member.

An electrical connector as above, wherein the fastening member further comprises a threaded portion having left hand threads.

An electrical connector as above, wherein the fastening member further comprises a threaded portion having left hand threads.

An electrical connector as above, wherein the fastening member further comprises a threaded portion, and a non-threaded shank portion, wherein the threaded portion is between the operable portion and the non-threaded shank portion.

An electrical connector as above, wherein the fastening member movably connects the upper member to the lower member.

An electrical connector as above, wherein the electrical connector is adapted such that resilient member compresses as the fastening member is threaded out of the hole in a direction away from the lower member.

An electrical connector as above, wherein the upper member further comprises a conductor lead in feature proximate the upper groove portion.

(4) In another exemplary embodiment, a method of manufacturing an electrical connector comprising: providing an upper member comprising a first end, a second end, and an upper groove portion, wherein the second end is opposite the first end, and wherein the upper groove portion is between the first end and the second end; providing a lower member comprising a lower groove portion, a receiving area, and a hole, wherein the lower groove portion is opposite the upper groove portion, wherein the second end of the upper member extends into the receiving area, and wherein an end of the hole is at the receiving area; engaging a fastening member at the hole, wherein the fastening member comprises a first end and an opposite second end, and wherein the first end of the fastening member comprises an operable portion; providing a spring between the upper member and a second end of the fastening member; and providing a spring retaining portion at the second end of the fastening member, wherein the spring retaining portion is at the first end of the upper member.

A method as above, wherein engaging the fastening member further comprises threadably engaging the fastening member to the hole.

A method as above, wherein the providing of the spring retaining portion further comprises forming a pan head at the second end of the fastening member.

A method as above, wherein the providing of the spring further comprises inserting a portion of the spring into an opening of the upper member, wherein an end of the spring contacts the upper member, and wherein another end of the spring contacts the spring retaining portion.

It should be understood that the foregoing description is only illustrative of the invention. Various alternatives and modifications can be devised by those skilled in the art without departing from the invention. Accordingly, the invention is intended to embrace all such alternatives, modifications and variances which fall within the scope of the appended claims.

What is claimed is:

1. An electrical connector comprising:

an upper member comprising a first end, a second end, and an upper groove portion, wherein the second end is opposite the first end, wherein the upper groove portion is between the first end and the second end, and wherein the first end comprises a first opening;

a lower member comprising a lower groove portion, a receiving area, and a hole, wherein the lower groove portion is opposite the upper groove portion, wherein a portion of the upper member extends into the receiving area, and wherein an end of the hole is at the receiving area;

a fastening member extending through the hole and the first opening, wherein the fastening member comprises a first end and an opposite second end, and wherein the first end of the fastening member comprises an operable portion; and a spring between the second end of the fastening member and the upper member, wherein a portion of the spring is in the first opening, and wherein the first end of the upper member is between opposite ends of the spring.

2. An electrical connector as in claim 1 wherein the hole of the lower member further comprises a threaded hole.

3. An electrical connector as in claim 1 wherein the operable portion of the fastening member further comprises an eyelet.

4. An electrical connector as in claim 1 wherein the lower member further comprises an aperture, and wherein the lower member is adapted to receive a first conductor at the aperture.

5. An electrical connector as in claim 1 wherein the hole of the lower member further comprises a threaded hole, and wherein the operable portion of the fastening member further comprises an eyelet.

6. An electrical connector as in claim 5 wherein the lower member further comprises an aperture, and wherein the lower member is adapted to receive a first conductor at the aperture.

7. An electrical connector as in claim 6 wherein the electrical connector is adapted to receive a second conductor between the upper member and the lower member.

8. An electrical connector as in claim 1 wherein the second end of the fastener comprises a pan head, and wherein the pan head is adapted to contact an end of the spring.

9. An electrical connector as in claim 1 wherein the fastening member comprises a threaded portion proximate the operable portion and a non-threaded portion proximate the second end.

10. An electrical connector comprising:

an upper member comprising a first end and a second end, wherein the first end comprises an opening;

a lower member comprising a cavity, a hole, and an aperture, wherein a portion of the upper member is received at the cavity, wherein an end of the hole is at the cavity, wherein the aperture is adapted to receive a first conductor, and wherein the electrical connector is adapted to receive a second conductor between the upper member and the lower member;

a fastener extending through the hole and the opening, wherein the fastener comprises a first end, an opposite second end, a first portion, and a second portion, wherein the lower member is engaged with the first portion of the fastener, and wherein the upper member is movably connected to the second portion of the fastener; and a spring at the second portion of the fastener, wherein the spring exerts a biasing force between an end of the fastener and the upper member, wherein the spring is between the second end of the fastener and the upper member, wherein a portion of the spring is in the opening, and wherein the first end of the upper member is between opposite ends of the spring.

11. An electrical connector as in claim 10 wherein the first portion of the fastener comprises a threaded portion.

12. An electrical connector as in claim 10 wherein the second portion of the fastener comprises a non-threaded portion.

13. An electrical connector as in claim 10 wherein the fastener comprises a pan head, wherein the pad head is spaced from the upper member when the connector is in a first position, and wherein the pan head is in contact with the upper member when the connector is in a second position.

14. An electrical connector as in claim 10 wherein the hole of the lower member comprises a threaded hole having left hand threads.

15. An electrical connector as in claim 10 wherein the fastener comprises an eyebolt.

16. An electrical connector comprising:

an upper member comprising a first end, a second end, an upper groove portion, and boss portion, wherein the second end is opposite the first end, wherein the upper groove portion is between the first end and the second end, wherein the first end comprises a first opening, wherein the second end comprises a second opening, and wherein the boss portion is at the second end;

a lower member comprising a lower groove portion, a receiving area, an aperture, and a hole, wherein the receiving area is between the lower groove portion and the aperture, wherein an end of the hole is at the receiving area, and wherein at least part of the boss portion is at the receiving area;

a fastening member extending through the hole and the second opening, wherein the fastening member comprises a first end and an opposite second end, wherein the first end of the fastening member comprises an operable portion, and wherein the second end of the fastening member extends beyond the first end of the upper member; and a resilient member between the second opening and the second end of the fastening member.

17. An electrical connector as in claim 16 wherein the fastening member further comprises a threaded portion having left hand threads.

18. An electrical connector as in claim 16 wherein the fastening member further comprises a threaded portion, and a non-threaded shank portion, wherein the threaded portion is between the operable portion and the non-threaded shank portion.

19. An electrical connector as in claim 16 wherein the fastening member movably connects the upper member to the lower member.

20. An electrical connector as in claim 16 wherein the electrical connector is adapted such that resilient member compresses as the fastening member is threaded out of the hole in a direction away from the lower member.

21. An electrical connector as in claim 16 wherein the upper member further comprises a conductor lead in feature proximate the upper groove portion.

22. A method of manufacturing an electrical connector comprising:

providing an upper member comprising a first end, a second end, and an upper groove portion, wherein the second end is opposite the first end, and wherein the upper groove portion is between the first end and the second end;

providing a lower member comprising a lower groove portion, a receiving area, and a hole, wherein the lower groove portion is opposite the upper groove portion, wherein the second end of the upper member extends into the receiving area, and wherein an end of the hole is at the receiving area;

engaging a fastening member at the hole, wherein the fastening member comprises a first end and an opposite second end, and wherein the first end of the fastening member comprises an operable portion;

providing a spring between the upper member and a second end of the fastening member; and providing a spring retaining portion at the second end of the fastening member, wherein the spring retaining portion is at the first end of the upper member.

23. A method as in claim 22 wherein engaging the fastening member further comprises threadably engaging the fastening member to the hole.

24. A method as in claim 22 wherein the providing of the spring retaining portion further comprises forming a pan head at the second end of the fastening member.

25. A method as in claim 22 wherein the providing of the spring further comprises inserting a portion of the spring into an opening of the upper member, wherein an end of the spring contacts the upper member, and wherein another end of the spring contacts the spring retaining portion.

* * * * *